United States Patent [19]

Sjöstrand

[11] 4,081,944

[45] Apr. 4, 1978

[54] ARRANGEMENT FOR THE READING OF PHOTOCELL MARKINGS ON A MATERIAL WEB PROVIDED WITH DECORATION

[75] Inventor: Uno Roland Sjöstrand, Flyinge, Sweden

[73] Assignee: AB Ziristor, Lund, Sweden

[21] Appl. No.: 747,097

[22] Filed: Dec. 3, 1976

[30] Foreign Application Priority Data

Dec. 19, 1975 Sweden ..... 7514444

[51] Int. Cl.[2] ..... B65B 41/18

[52] U.S. Cl. ..... 53/51; 226/2; 226/28

[58] Field of Search ..... 53/51; 226/2, 28, 29, 226/30

[56] References Cited

U.S. PATENT DOCUMENTS

| | | | |
|---|---|---|---|
| 2,977,730 | 4/1961 | Ardner | 53/51 |
| 3,629,987 | 12/1971 | Klopfenstein et al. | 53/51 X |
| 3,788,028 | 1/1974 | Folkesson et al. | 53/51 |
| 3,977,586 | 8/1976 | Hertrich | 226/2 |
| 4,009,551 | 3/1977 | Greenawalt et al. | 53/51 |

*Primary Examiner*—Robert Louis Spruill

*Attorney, Agent, or Firm*—Burns, Doane, Swecker & Mathis

[57] ABSTRACT

An apparatus for reading photocell markings applied at equal intervals on the decorated side of a material web run through a packing machine for the continuous manufacture of separatable packages provided with transverse crease lines in which a cylindrical monitoring element which contacts and is rotated by the crease lines functions to periodically actuate an electrical switch which in turn activates a photocell located close to the web when a photocell marking is calculated to pass.

1 Claim, 1 Drawing Figure

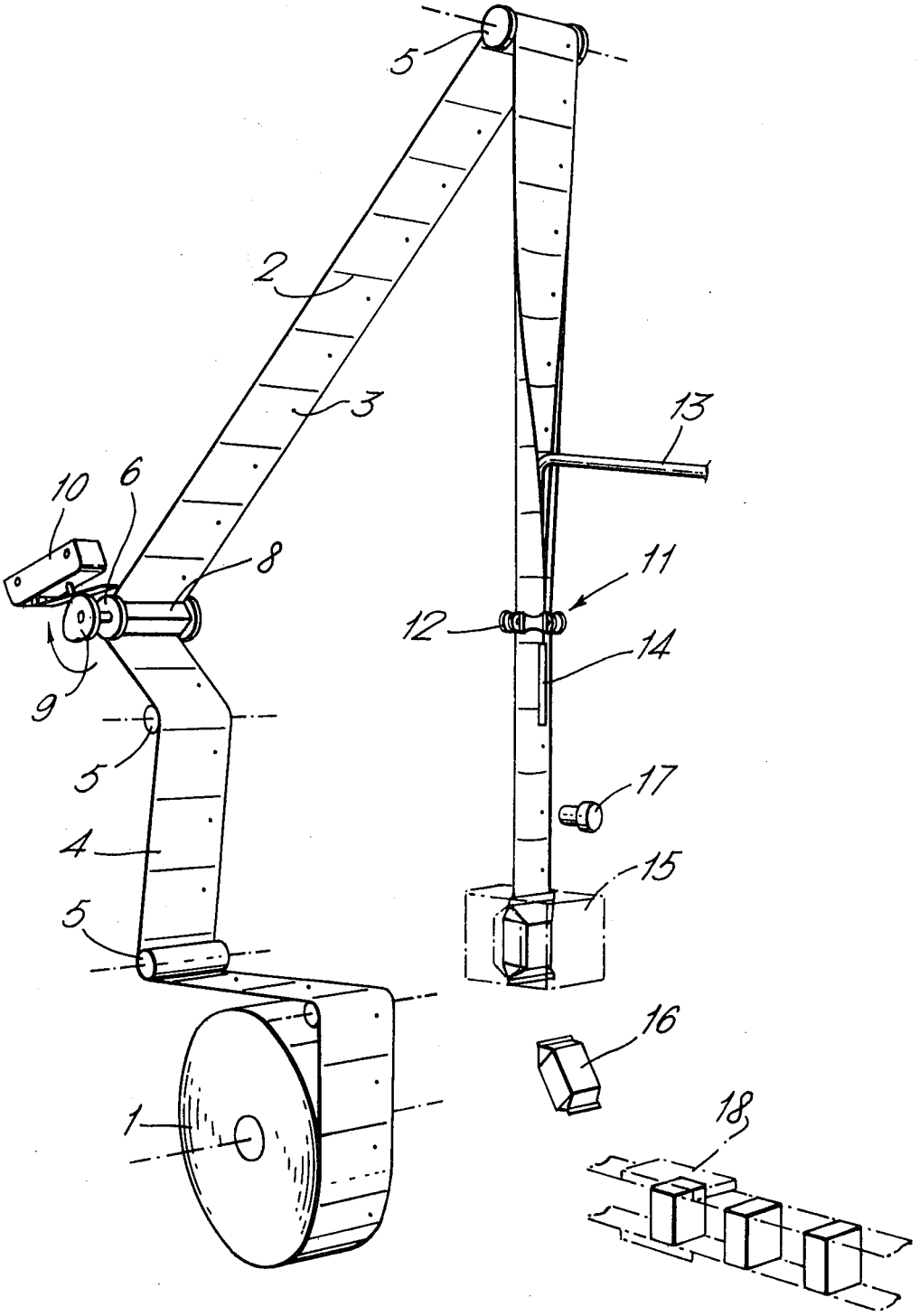
5
2
3
13
10
6
8
11
12
14
9
5
17
4
15
5
16
1
18

ARRANGEMENT FOR THE READING OF PHOTOCELL MARKINGS ON A MATERIAL WEB PROVIDED WITH DECORATION

The present invention relates to an apparatus for the reading of photocell markings, which are applied at equal intervals on the decorated side of a material web, in a packing machine for the continuous manufacture of separate packages from a material we provided with decoration and crease lines. The arrangement comprises elements for the successive transformation of a material web provided with decoration and crease lines to a tube with a longitudinal joint, elements for conducting the material to be packed to the tube, elements for the transverse sealing of the tube and shaping of the packages formed.

Machines for the continuous manufacture of filled and sealed packages from a moving material web are known. The material web consists of plastic laminate impervious to liquids which is introduced into the packing machine in the form of a roll. The web is then already provided with the desired decoration pattern and with transverse as well as longitudinal crease lines, which are made use of for the ultimate shaping of the package. Thus it has to be ensured, when feeding the packing material web into the packing machine, that the decoration pattern and the crease lines come into the correct position on the finished shaped package, that is to say, that decoration and crease lines are in register with the packages. Even if this is the case when starting up the packing machine, the decoration and the crease lines will gradually move out of register owing to elongations in the packing material web, permitted machine tolerances and other inevitable sources of error. This makes it necessary continuously to monitor the position of the decoration and of the crease lines, and in order to prevent further inaccuracy this should be done as late as possible before the transformation to packages.

In a known packing machine the problem is solved with the help of a photocell which is placed directly in front of the elements which shape the packages. The photocell picks up photocell markings which are arranged at equal intervals on the decorated side of the packing material web. The photocell markings consist of well delimited dark spots which are printed against a light background onto the packing material web. To avoid the photocell being acted upon by the remaining print (decorations) on the material web, the photocell markings are placed in a region which is free of decoration and which extends along the packing material web. The photocell device continuously monitors the position of each photocell marking when the package is shaped, and if the register-holding is found to be faulty, the photocell device acts upon the jaws which shape the packages, so that the jaws on shaping subsequent packages successively compensate for the faulty holding of register.

The arrangement described functions well, but has the disadvantage that the material has to be provided with the said decoration-free region in which the photocell markings are printed at regular distances. This is a disadvantage, since it is of course desirable to have a whole and unbroken decoration around the whole circumference of the package. It has been tried to avoid the problem by shifting the decoration-free region to one edge of the material web, and, more precisely, that edge which during the transformation of the material web to a tube is placed underneath the other edge in an overlap joint, and thus is not visible on the finished package. The longitudinal tube joint is not sufficiently wide, however, without making the decoration-free region so narrow that there is a risk of faulty readings. Furthermore, the accuracy will be impaired by placing the markings precisely at the edge, since the latter is not so stable in its shape, but stretches and alters its shape to a greater extent than the area situated centrally on the packing material web.

It is an object of the present invention to avoid the need for a decoration-free region. This has been achieved in accordance with the invention by providing an arrangement wherein an element actuated by the transverse crease lines of the moving material web is made to activate a photocell unit located close to the material web at repeated, relatively short periods when a photocell marking is calculated to pass.

This object has been achieved in accordance with the invention in that an arrangement has a rotating crease monitoring element which comprises a device engaging transverse crease lines of a material web passing by, and a cam, driven by a monitoring element, which acts upon a switch so as to actuate instantaneously in rhythm with the rotation of a monitoring element a photocell unit arranged by the tubular part of the material web.

The invention will now be described in detail with reference to the attached schematic drawing which perspectively illustrates the method and the arrangement in accordance with the invention.

The drawing shows only the details essential for the understanding of the invention, and the packing machine itself as well as a large number of elements processing the packing material web, which are well known to those versed in the art, have been omitted. A material web 4 provided with transverse crease lines 2 and photocell markings 3 passes from a roll 1 of packing material via a number of guide rolls 5 to a monitoring element 6. The monitoring element 6 is freely rotating around an axis arranged transversely in respect of the material web 4 and has longitudinal, edge-shaped devices 8 which are adapted to engage the transverse crease lines 2 of the material web 4 passing by, so that the cylindrical element 6 rotates synchronously with the material web 4 passing by. At the one end of the monitoring element or cylinder 6 a cam 9 is arranged which cam influences a switch 10 between an open and a closed position.

From the guide roll 5 the material web 4 passes substantially vertically downwards with successive transformation to tubular shape. The transformation to tubular shape takes place by means of a shaping ring 11 which comprises a number of freely rotating rolls 12 arranged in a ring around the material web. Above the shaping ring 11 a delivery pipe 13 is located for the contents, which extends between the two longitudinal edges of the material web partly transformed to tubular shape. Underneath the shaping ring 11, there is a sealing element 14 which continuously seals the longitudinal joint of the packing material tube formed. At the bottom end of the material tub, there is an element 15 for the transverse sealing of the tube and for the shaping and cutting of the same to separate closed packages 16. Above the element 15 is a photocell 17 which is directed towards the material tube and is adapted to monitor the photocell markings 3. After the cutting, the partly shaped packages 16 are conveyed to a shaping element 18, in which the packages 16 are given their final parallelepipedic shape by folding in of corner lugs formed during the transverse sealing. The finished packages are then conveyed further to be packed in collecting containers or the like.

The photocell unit 17 is electrically connected to the switch 10 arranged by the monitoring element 6 and is activated or inactivated by the same. The switch 10 in turn is influenced between closed and open position by the cam 9 coupled to the monitoring element, which cam 9 rotates in the same rhythm as the monitoring element 6. The cam 9 is designed so that the switch 10 closes the circuit to the photocell unit 17 only during a small part of each rotation of the cam 9. This short period, during which the photocell unit 17 is activated, corresponds to the period during which a photocell marking 3 is essentially opposite the photocell unit 17. The photocell unit is thus inactive during the time the material tube moves downwards until the next photocell marking approaches the photocell unit 17. Consequently the photocell unit is not acted upon by decoration or other pattern on the packing material tube situated between the photocell markings 3, the need for the decorationfree regions required previously is eliminated.

By the method and the arrangement in accordance with the invention an uninterrupted decoration on all the normally visible surfaces of the package has been made possible, since the photocell markings still necessary, and the contrast area surrounding the same, can simply be placed on the bottom of the package.

What is claimed is:

1. In an apparatus for forming a tube-like member from a longitudinal web of packaging material provided with longitudinally spaced transverse creases and spaced transverse decorations thereon between the transverse creases and providedwith photocell markings between the transverse decorations, in which the tube-like member is filled with a contents and then transversely sealed, shaped and severed into packages in register with the crease lines, the web and filled tube-like member being subject to elongation prior to the sealing, shaping and severing of the filled tube-like member, the improvement of means for controlling the register of the creases of the tube-like member, after filling with contents, with means for sealing, shaping and severing, said controlling means comprising means engagable with the spaced transverse creases on the web prior to formation of the web into the tube-like member and rotatable thereby, switch means responsive to said crease engaging means and operable intermittently thereby, a photocell disposed adjacent the filled tube-like member immediately preceeding the means for sealing, shaping and severing the filled tube-like member and intermittently activated by said switch means when a photocell marking is about to pass said photocell means thereby preventing activation of said photocell means while the spaced transverse decorations are passing said photocell means, said means for sealing, shaping and severing said filled tube-like member being activated when said photocell means reads a photocell marking on said tube-like member whereby elongation of the web and the tube-like member is compensated for.

* * * * *